US010415889B2

(12) United States Patent
Tomioka et al.

(10) Patent No.: US 10,415,889 B2
(45) Date of Patent: Sep. 17, 2019

(54) GAS COOLER HAVING AN INSERTABLE COOLING PORTION

(71) Applicant: Kobe Steel, Ltd., Kobe-shi (JP)

(72) Inventors: Yusuke Tomioka, Kako-gun (JP); Kazuya Hirata, Kako-gun (JP); Koji Hagihara, Kako-gun (JP); Yasuto Kataoka, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 307 days.

(21) Appl. No.: 15/300,439

(22) PCT Filed: Mar. 12, 2015

(86) PCT No.: PCT/JP2015/057349
§ 371 (c)(1),
(2) Date: Sep. 29, 2016

(87) PCT Pub. No.: WO2015/156082
PCT Pub. Date: Oct. 15, 2015

(65) Prior Publication Data

US 2017/0167797 A1 Jun. 15, 2017

(30) Foreign Application Priority Data

Apr. 9, 2014 (JP) ..... 2014-080425

(51) Int. Cl.
*F28F 7/00* (2006.01)
*F28F 9/00* (2006.01)
(Continued)

(52) U.S. Cl.
CPC ..... *F28D 7/1653* (2013.01); *F28D 7/16* (2013.01); *F28F 1/325* (2013.01); *F28F 9/00* (2013.01);
(Continued)

(58) Field of Classification Search
CPC ..... F28D 7/1653; F28D 7/16; F28D 9/0006; F28F 9/00; F28F 9/001
(Continued)

(56) References Cited

U.S. PATENT DOCUMENTS 2,552,416 A 5/1951 Farkas
4,138,969 A * 2/1979 Thompson ..... F28F 11/00 122/421
(Continued)

FOREIGN PATENT DOCUMENTS

JP 48-000662 1/1973
JP 53-50541 A 4/1978
(Continued)

OTHER PUBLICATIONS

International Preliminary Report on Patentability and Written Opinion of the International Searching Authority dated Oct. 20, 2016 in PCT/JP2015/057349 filed Mar. 12, 2015 (with English translation).
(Continued)

*Primary Examiner* — Paul Alvare
(74) *Attorney, Agent, or Firm* — Oblon, McClelland, Maier & Neustadt, L.L.P.

(57) ABSTRACT

A gas cooler includes a pair of seal plates and a pair of first support ribs. The individual seal plate has a stepped surface which extends in a direction that a cooling portion is inserted into a casing. The individual first support rib supports the stepped surface. With the configuration where the stepped surface is supported by the first support rib, the inside of the casing is partitioned into an upstream-side space communicated with an introducing port and a downstream-side space communicated with a discharging port.

12 Claims, 13 Drawing Sheets

(51) Int. Cl.

| | |
|---|---|
| ***F28D 7/16*** | (2006.01) |
| ***F28F 9/013*** | (2006.01) |
| ***F28F 1/32*** | (2006.01) |
| *F04C 18/16* | (2006.01) |
| *F04C 29/04* | (2006.01) |

(52) U.S. Cl.
CPC ..... *F28F 9/001* (2013.01); *F28F 9/013* (2013.01); *F28F 9/0131* (2013.01); *F04C 18/16* (2013.01); *F04C 29/04* (2013.01); *F28F 2009/004* (2013.01); *F28F 2230/00* (2013.01); *F28F 2280/10* (2013.01)

(58) Field of Classification Search
USPC ..... 165/78, 162
See application file for complete search history.

(56) References Cited

U.S. PATENT DOCUMENTS 4,215,745 A * 8/1980 Tuckmantel ..... F28F 9/005 165/160
4,548,260 A * 10/1985 Stachura ..... F28D 7/1646 165/160
4,903,762 A * 2/1990 Marsais ..... F28D 1/05383 165/149
7,837,954 B2 * 11/2010 Lehr ..... B01J 8/008 165/104.19
2002/0001531 A1 1/2002 Takahashi et al.
2002/0050345 A1 * 5/2002 Miura ..... F28D 9/0062 165/166
2002/0081213 A1 6/2002 Takahashi et al.
2003/0131977 A1 * 7/2003 West ..... F28D 7/1676 165/159
2009/0211733 A1 * 8/2009 Tranier ..... F25J 3/04412 165/104.21
2014/0138071 A1 * 5/2014 Odillard ..... F02B 29/0475 165/164

FOREIGN PATENT DOCUMENTS

| | | | |
|---|---|---|---|
| JP | 53-160062 | | 12/1978 |
| JP | 55-112991 | A | 9/1980 |
| JP | 57-56066 | Y2 | 12/1982 |
| JP | 07-32462 | A | 6/1995 |
| JP | 08-20230 | A | 1/1996 |
| JP | 10-300158 | A | 11/1998 |
| JP | 2000-120585 | A | 4/2000 |
| JP | 2001-330381 | A | 11/2001 |
| JP | 2002-21759 | A | 1/2002 |
| JP | 2002-67707 | A | 3/2002 |
| JP | 2014-005881 | A | 1/2014 |

OTHER PUBLICATIONS

Extended European Search Report dated Dec. 6, 2017 in Patent Application No. 15776818.5.
International Search Report dated Jun. 16, 2015 in PCT/JP2015/057349 filed Mar. 12, 2015.

* cited by examiner

GAS COOLER HAVING AN INSERTABLE COOLING PORTION

CROSS-REFERENCE TO RELATED APPLICATIONS

This is a national phase application in the United States of International Patent Application No. PCT/JP2015/057349 with an international filing date of May 12, 2015, which claims priority of Japanese Patent Application No. 2014-080425 filed on Apr. 9, 2014 the contents of which are incorporated herein by reference.

TECHNICAL FIELD

The present invention relates to a gas cooler.

BACKGROUND ART

JP 2002-21759 discloses an intercooler where a shell-and-tube type heat exchanger is used in a cooler portion, air is made to flow on a tube outer side of a cooler nest of the heat exchanger, and cooling water is made to flow on a tube inner side. To enhance heat transfer efficiency, a cooler casing is formed such that a width of the cooler casing between side surfaces of the casing is set larger than a width of a cooler nest insertion opening, and two seal plates are disposed in a portion formed widely between side surfaces of the casing.

The cooler nest is inserted into the cooler casing through the cooler nest insertion opening in a cantilever state. When the seal plates are brought into pressure contact with the side surfaces of the casing with such an operation, the inside of the cooler casing is partitioned into a high-temperature side which forms an upper portion of the nest and a low-temperature side which forms a lower portion of the nest.

The cooler nest extends in an elongated manner in a horizontal direction which is the insertion direction. The seal plate has a size which allows the seal plate to be brought into pressure contact with the side surface of the casing due to insertion of the cooler nest. Accordingly, assembling operability at the time of installing the cooler nest and two seal plates at predetermined positions in the inside of the cooler casing is bad.

Further, at the time of inserting the cooler nest through the cooler nest insertion opening, the cooler nest has a larger width than the cooler nest insertion opening due to the provision of the seal plates and hence, it is difficult to dispose an end portion of the cooler nest which is disposed on a side opposite to the cooler nest insertion opening and is supported in a cantilever state at an optimum position. Accordingly, after the cooler nest is inserted into the cooler casing, it is necessary to perform the cooler nest positioning operation such that the cooler nest assumes an optimum position for sealing by making the seal plates advance while being brought into pressure contact with the side surfaces of the casing by the end portion of the cooler nest. Accordingly, assembling operability is further worsened.

SUMMARY OF THE INVENTION

Problems to be Solved by the Invention

It is an object of the present invention to provide a gas cooler which can enhance maintainability thereof while ensuring cooling efficiency thereof.

Means for Solving the Problems

A gas cooler according to the present invention includes a casing having an opening; an introducing port through which a gas is introduced into the inside of the casing; a discharging port through which the gas is discharged from the inside of the casing; a cooling portion which is inserted into the casing through the opening, is housed in the casing, cools the gas, and maintains air-tightness against the opening; a pair of seal plates which is disposed in the cooling portion, and has portions to be supported which extend in a direction that the cooling portion is inserted; and a pair of support portions which is provided for supporting the portions to be supported, the support portions being disposed on an inner surface of the casing such that the pair of support portions projects into the inside of the casing and extends in the insertion direction, wherein the portions to be supported are placed on the support portions so as to partition the inside of the casing into an upstream-side space communicated with the introducing port and a downstream-side space communicated with the discharging port.

With such a configuration, the cooling portion is supported by the pair of support portions which projects into the inside of the casing by way of the pair of seal plates and hence, sealing can be easily made between the portions to be supported and the support portions. Accordingly, even when the seal plates are not brought into pressure contact with the inner surface of the casing, the inside of the casing can be partitioned into the upstream-side space and the downstream-side space with the cooling portion interposed therebetween. That is, the inside of the casing is partitioned such that the upstream-side space forms a high-temperature side space and the downstream-side space forms a low-temperature side space and hence, heat transfer efficiency of the gas cooler can be enhanced. Accordingly, cooling efficiency of the gas cooler can be enhanced. Further, the portions to be supported which extend in the insertion direction of the cooling portion are placed on the support portions which extend in the insertion direction and hence, the inside of the casing can be partitioned into the upstream-side space and the downstream-side space whereby assembling operability, that is, maintainability can be enhanced. Accordingly, cooling efficiency and maintainability of the gas cooler can be enhanced.

It is preferable that the casing have both side wall portions which opposedly face each other as viewed in the insertion direction, and the pair of support portions be disposed on inner surfaces of said both side wall portions. With such a configuration, the inside of the casing can be partitioned vertically and hence, the flow of a gas can be directed from an upper side to a lower side whereby a drain can be easily separated from the cooling portion.

The casing may be configured to have a bottom wall portion, and the pair of support portions may be disposed on an inner surface of the bottom wall portion as viewed in the insertion direction.

It is preferable that the inner surface be formed into a flat surface shape, and the inner surface and the support portions be integrally formed with each other along the insertion direction. With such a configuration, the support portions can be also used as ribs. By allowing the support portions to function as the ribs, the expansion of center portions of respective wall portions of the casing in the insertion direction can be suppressed whereby a stress and, eventually, displacement in the wall portions of the casing can be reduced. Accordingly, reliability on strength of the gas cooler having an approximately rectangular parallelepiped shape can be enhanced.

It is preferable that a size of a profile of the cooling portion in a state where the pair of seal plates is disposed in the cooling portion be smaller than a size of the opening as viewed in the insertion direction, the pair of support portions is disposed so as to project toward the inside from a peripheral edge of the opening, and the pair of seal plates in a state where the pair of seal plates is disposed in the cooling portion be configured to be movable in the insertion direction in a state where the support portions and the portions to be supported are brought into contact with each other. With such a configuration, the support portions can be used as guides and hence, the cooling portion can be inserted into the inside of the casing while allowing the cooling portion to slide on the guides by way of the seal plates. Further, the cooling portion can be inserted into the inside of the casing through the opening without inclining the cooling portion. Accordingly, the cooling portion can be installed more easily thus remarkably enhancing maintainability. Still further, it is possible to avoid applying of an extra external force to the cooling portion and the seal plates from the casing at the time of inserting the cooling portion.

It is preferable that the pair of seal plates have stepped portions which are formed such that lower end portions of the pair of seal plates approach to each other as viewed in the insertion direction, and the portions to be supported be downwardly-facing stepped surfaces of the stepped portions. With such a configuration, it is possible to insert the cooling portion into the inside of the casing in a state where lower end portions of the pair of seal plates are positioned below the downwardly-facing stepped surfaces between the pair of support portions. Accordingly, the cooling portion can be inserted into the inside of the casing while the positional regulation in the vertical direction is performed by the downwardly-facing stepped surface and the support portion and, at the same time, the positional regulation in the lateral direction is performed by the lower end portions below the downwardly-facing stepped surface and the support portion. Accordingly, stability of insertion of the cooling portion can be enhanced.

It is preferable that a resilient member be disposed on the stepped surface, and the portion to be supported be placed on the support portion with the resilient member interposed therebetween thus partitioning the inside of the casing into the upstream-side space and the downstream-side space. With such a configuration, even when a gap is formed at the time of mounting the seal plate on the casing, the gap can be filled with the resilient member. Accordingly, it is possible to prevent with certainty a high-temperature gas in the upstream-side space from flowing into the downstream-side space through a short path and hence, cooling efficiency can be enhanced.

It is preferable that the resilient member be a sponge-like resilient body. With such a configuration, the resilient member can be formed using a relatively inexpensive material.

It is preferable that the cooling portion have a plurality of cooling water flow paths through which cooling water flows, and gas flow paths be disposed between the plurality of cooling water flow paths. With such a configuration, it is possible to allow a gas to pass through the cooling portion without being brought into contact with cooling water.

It is preferable that the plurality of cooling water flow paths be formed of a plurality of cooling pipes each of which has a straight portion extending in the insertion direction, the straight portions being disposed parallel to each other, and the plurality of cooling water paths include a plurality of fins which are disposed at intervals from each other in the insertion direction, and are integrally formed with the cooling pipe, and the pair of seal plates be disposed so as to cover side portions of the cooling portion from outside of the plurality of fins. With such a configuration, the fins are formed in the cooling portion such that a gas introduced into the cooling portion from the introducing port can easily flow toward a lower side from an upper side and hence, gas cooling efficiency and drain separation efficiency can be enhanced.

It is preferable that the seal plate include a positioning portion which determines an insertion position for insertion into the inside of the casing. With such a configuration, the seal plates can be always positioned at desired seal positions.

Effect of the Invention

According to the present invention, the gas cooler includes the portions to be supported of the seal plates extending in the insertion direction of the cooling portion and the support portions which project into the inside of the casing and hence, the inside of the casing can be partitioned into the upstream-side space and the downstream-side space by merely placing the portions to be supported on the support portions. Accordingly, cooling efficiency of the gas cooler can be enhanced and, at the same time, maintainability can be also enhanced.

MODE FOR CARRYING OUT THE INVENTION

Hereinafter, embodiments of the present invention are explained with reference to drawings.

Figure 1A:
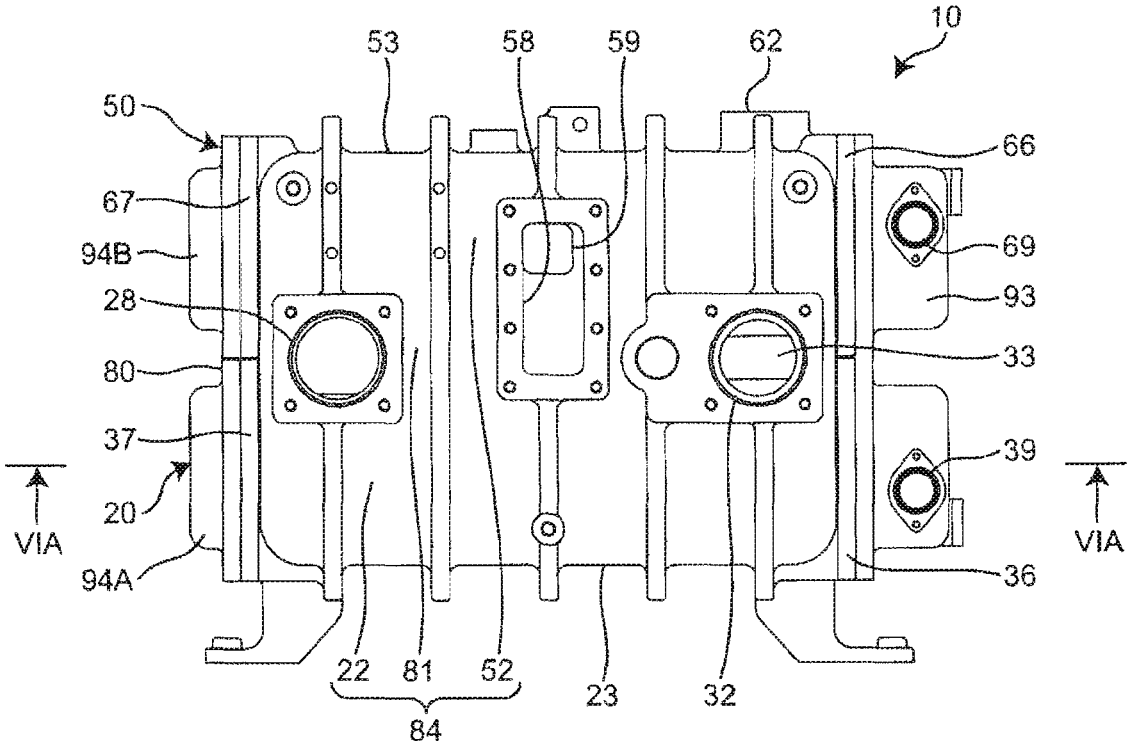
FIG. 1A is a plan view of a gas cooler according to the present invention.
Figure 1B:
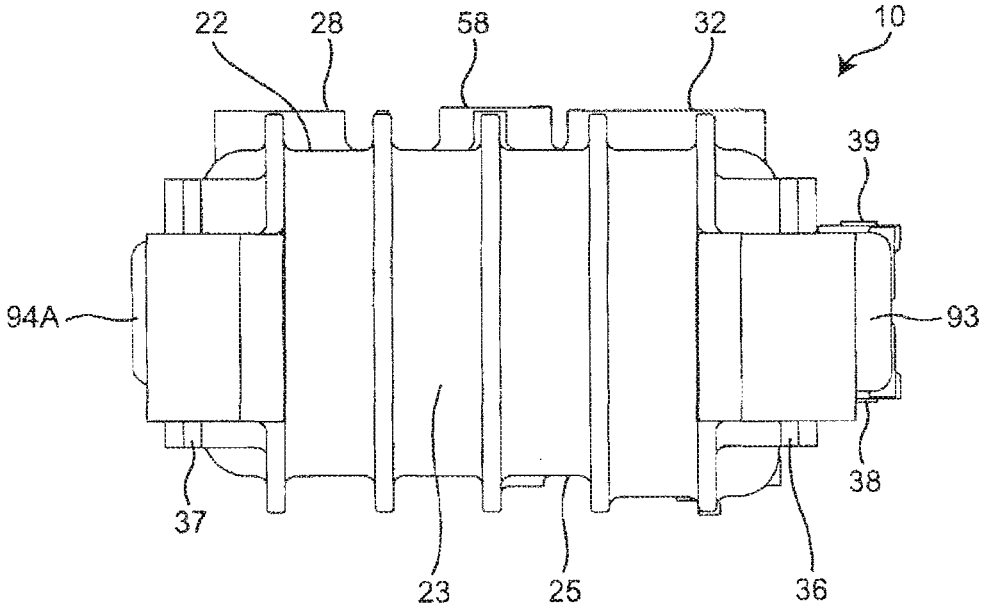
FIG. 1B is a front view of the gas cooler according to the present invention.

FIGS. 1A and 1B are a plan view and a front view of a gas cooler 10 according to the present invention respectively. For example, the gas cooler 10 is assembled into a compressor for cooling compressed air discharged from a compressor body. The gas cooler 10 of this embodiment includes an inter cooler (first gas cooler) 20 and an after cooler (second gas cooler) 50, and is formed as an integral body having an approximately rectangular parallelepiped shape. Hereinafter, the explanation is made by taking a case where the gas cooler 10 according to the present invention is assembled into a screw compressor including an oil-free two-stage screw compressor body as an example. In the screw compressor, the inter cooler 20 is disposed in a gas path between a low-stage-side screw compressor and a high-stage-side screw compressor, and the after cooler 50 is disposed in a gas path on a downstream side of the high-stage-side screw compressor.

As shown in FIGS. 2 to 5, the inter cooler 20 includes a first casing 21 which is formed into an approximately rectangular parallelepiped shape and has both ends thereof opened. The first casing 21 is molded by casting. Openings formed in the first casing 21 is constituted of a proximal-end-side first opening 211 which is a heat exchanger insertion opening, and a distal-end-side first opening 212. A portion of the first casing 21 around the proximal-end-side first opening 211 is a side wall portion 89. A portion of the first casing 21 around the distal-end-side first opening 212 is a side wall portion 90. A first mounting portion 36 described later is connected to the side wall portion 89 from the outside.

Figure 8:
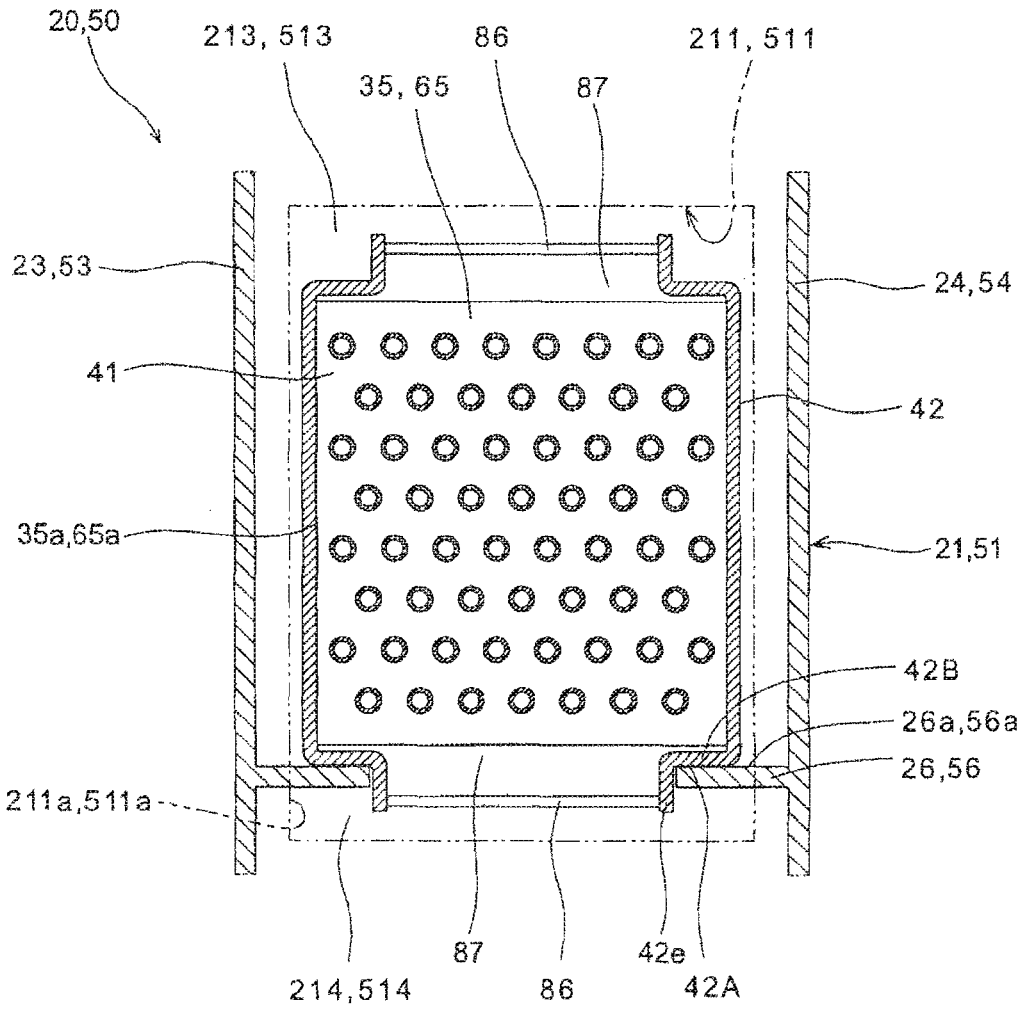
FIG. 8 is a schematic cross-sectional view for describing a main part of the present invention.

The first casing 21 includes a first ceiling wall portion 22, a first outer wall portion 23, a first inner wall portion 24, and a first bottom wall portion 25. The first outer wall portion 23 and the first inner wall portion 24 are respectively formed in a raised manner from the first bottom wall portion 25 and face each other in an opposed manner. As shown in FIG. 8, an inner surface of the first outer wall portion 23 and an inner surface of the first inner wall portion 24, that is, the inner surfaces which face a first cooling portion 35 in an opposed manner are formed into a flat surface shape respectively.

Figure 3:
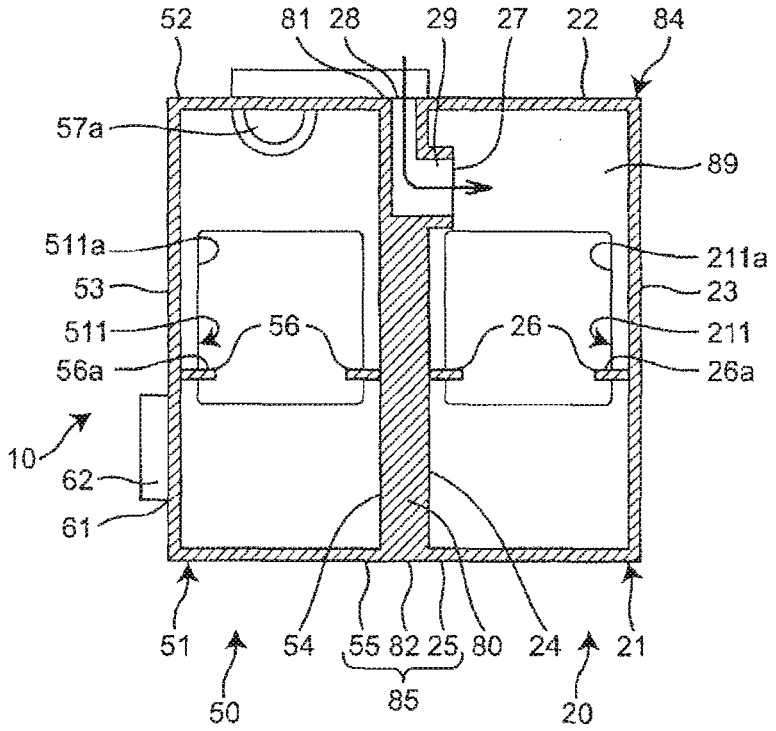
FIG. 3 is a schematic view of the gas cooler in cross section taken along a line III-III in FIG. 2.
Figure 6A:
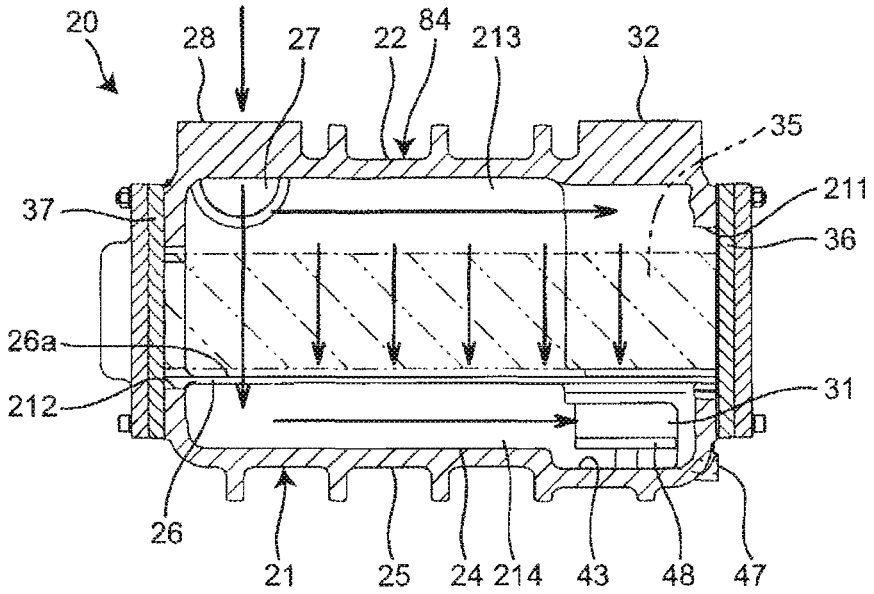
FIG. 6A is a cross-sectional view taken along a line VIA-VIA in FIG. 1A.
Figure 6B:
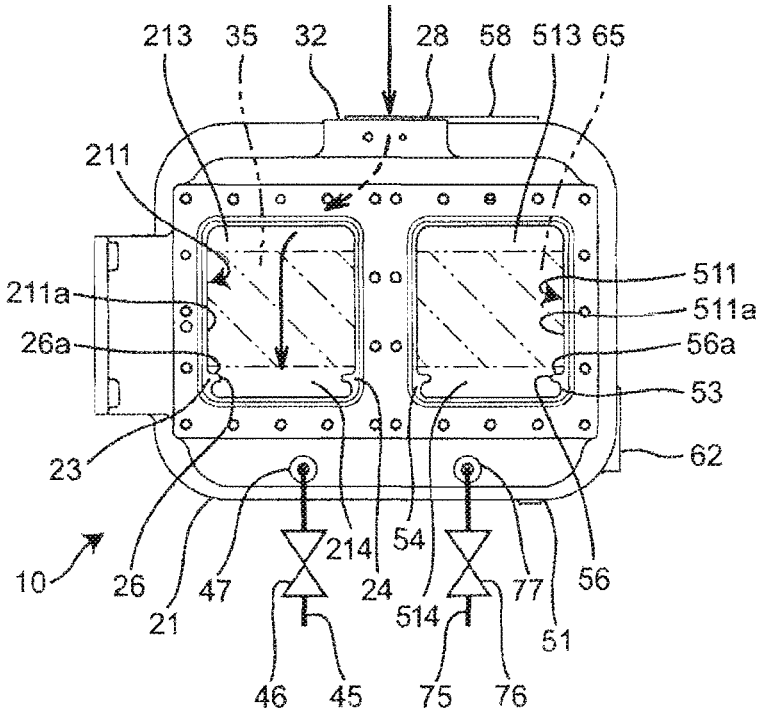
FIG. 6B is a right side view of a casing from which a mounting portion is removed.
Figure 7A:
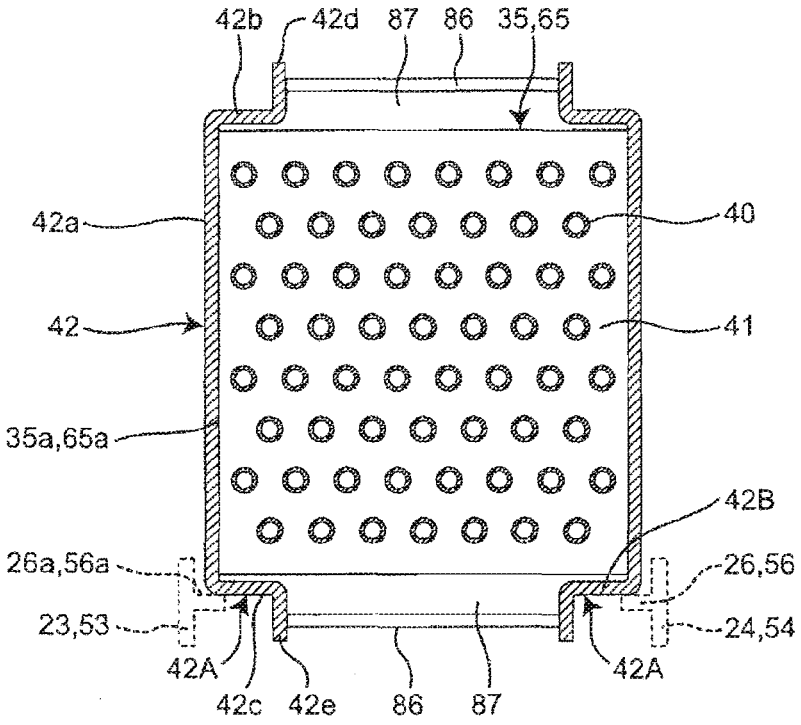
FIG. 7A is a schematic view showing a cross section of a cooling portion in an insertion direction.

As shown in FIGS. 6A, 6B and 8, on the inner surfaces of both the first outer wall portion. 23 and the first inner wall portion 24, a pair of first support ribs (support portions) 26, 26 is formed respectively in such a manner that the pair of first support ribs (support portions) 26, 26 supports stepped surfaces (portions to be supported) 42A of seal plates 42 disposed so as to cover side portions 35*a* of the first cooling portion (heat exchanger) 35 shown in FIG. 7A described later. The first support ribs 26 extend in an insertion direction of the first cooling portion 35. As shown in FIGS. 3 and 6B, the first support ribs 26 project toward the inside from a peripheral edges 211*a* of a proximal-end-side first opening 211 formed in the first casing 21, and such the projecting portions extend between one end side and the other end side of the first casing 21.

As shown in FIGS. 6A and 8, an upper surface 26*a* of the first support rib 26 is a flat surface having a length approximately equal to a length of the first casing 21 in the insertion direction. The upper surface 26*a* of the first support rib 26 is a contact surface which is brought into contact with the stepped surface 42A of the seal plate 42, and is approximately parallel to the stepped surface 42A. The first support ribs 26 are integrally formed with the first outer wall portion 23 and the first inner wall portion 24 respectively.

As shown in FIGS. 2 to 5, the after cooler 50 includes a second casing 51 which is formed into an approximately rectangular parallelepiped shape and has both ends thereof opened. The second casing 51 is molded by casting. Openings formed in the second casing 51 is constituted of a proximal-end-side second opening 511 which is a heat exchanger insertion opening, and a distal-end-side second opening 512. A portion of the second casing 51 around the proximal-end-side second opening 511 is a side wall portion 89. A portion of the second casing 51 around the distal-end-side second opening 512 is a side wall portion 90. A second mounting portion 66 described later is connected to the side wall portion 89 from the outside.

The second casing 51 includes a second ceiling wall portion 52, a second outer wall portion 53, a second inner wall portion 54, and a second bottom wall portion 55. The second outer wall portion 53 and the second inner wall portion 54 are respectively formed in a raised manner from the second bottom wall portion 55, and face each other in an opposed manner. As shown in FIG. 8, an inner surface of the second outer wall portion 53 and an inner surface of the second inner wall portion 54, that is, inner surfaces which face a second cooling portion 65 in an opposed manner are formed into a flat surface shape respectively.

As shown in FIGS. 6B and 8, on the inner surfaces of both the second outer wall portion 53 and the second inner wall portion 54, a pair of second support ribs (support portions) 56, 56 is formed respectively in such a manner that the pair of second support ribs (support portions) 56, 56 supports the stepped surfaces 42A of the seal plates 42 which are provided so as to cover the side portions 65*a* of the second cooling portion (heat exchanger) 65 shown in FIG. 7A described later. The second support rib 56 extends in an insertion direction of the second cooling portion (heat exchanger) 65 in the same manner as the first support rib 26. As shown in FIGS. 3 and 6B, the second support ribs 56 project toward the inside from peripheral edges 511*a* of a proximal-end-side second opening 511 formed in the second casing 51, and such projecting portions extend between one end side and the other end side of the second casing 51.

In the same manner as the upper surface 26*a* of the first support rib 26, an upper surface 56*a* of the second support rib 56 is a flat surface having a length approximately equal to a length of the second casing 51 in the insertion direction. The upper surface 56*a* of the second support rib 56 is a contact surface which is brought into contact with the stepped surface 42A of the seal plate 42, and is approximately parallel to the stepped surface 42A. The second support ribs 56 are integrally formed with the second outer wall portion 53 and the second inner wall portion 54 respectively.

Figure 4:
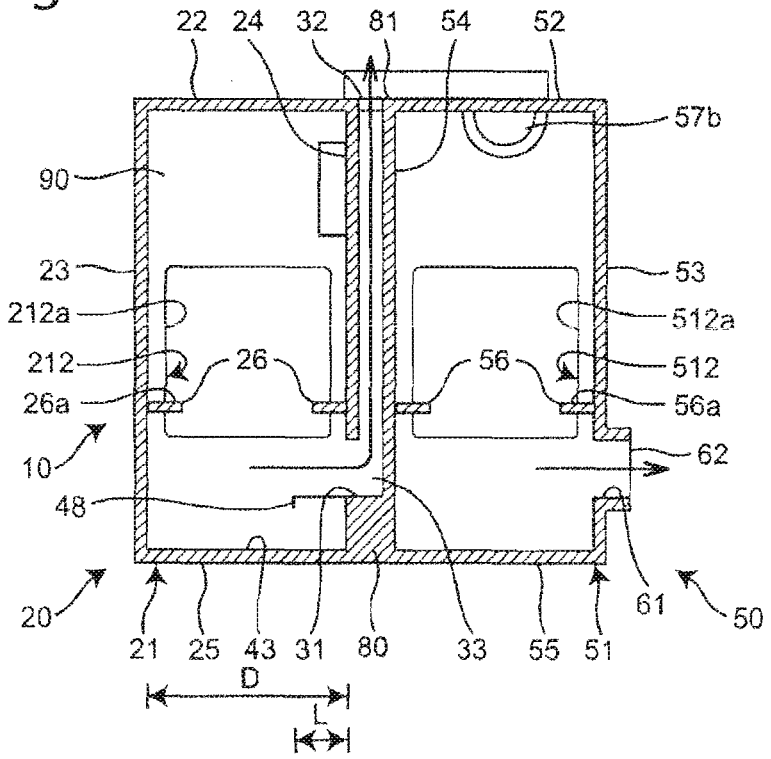
FIG. 4 is a schematic view of the gas cooler in cross section taken along a line IV-IV in FIG. 2.
Figure 5:
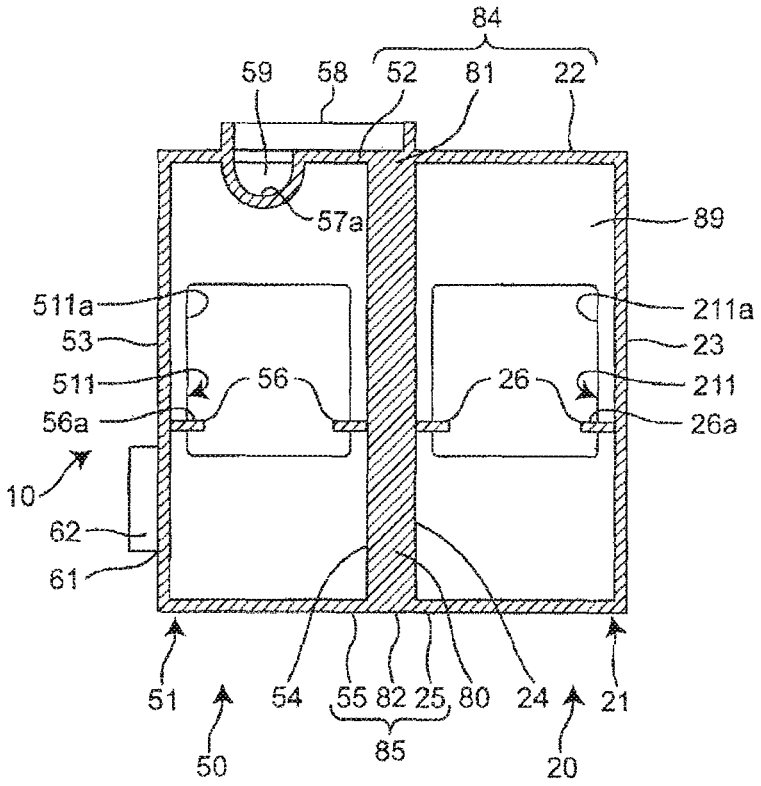
FIG. 5 is a schematic view of the gas cooler in cross section taken along a line V-V in FIG. 2.

As shown in FIGS. 3 to 5, the inter cooler 20 and the after cooler 50 are connected to each other by way of an intermediate portion 80. As shown in FIGS. 1A and 5, a portion of the intermediate portion 80 which connects the first ceiling wall portion 22 of the inter cooler 20 and the second ceiling wall portion 52 of the after cooler 50 to each other is an intermediate ceiling wall portion 81. The first ceiling wall portion 22, the intermediate ceiling wall portion 81, and the second ceiling wall portion 52 are formed as an integral body thus forming a common ceiling wall portion 84. Further, as shown in FIG. 3, a portion of the intermediate portion 80 which connects the first bottom wall portion 25 of the inter cooler 20 and the second bottom wall portion 55 of the after cooler 50 to each other is an intermediate bottom wall portion 82. The first bottom wall portion 25, the intermediate bottom wall portion 82, and the second bottom wall portion 55 are formed as an integral body thus forming a common bottom wall portion 85. In this embodiment, the intermediate portion 80 is integrally formed with the first inner wall portion 24 and the second inner wall portion 54.

As shown in FIGS. 3 and 6A, on a first ceiling wall portion 22 side of the first inner wall portion 24 of the inter cooler 20, a first introducing port 27 through which a gas is introduced into the inside of the first casing 21 is formed. The first introducing port 27 is disposed on one side of the first casing 21 in the horizontal direction (in a longitudinal direction of the first casing 21). The first introducing port 27 has an approximately semicircular shape. As shown in FIG. A, an introducing-side first connecting port 28 which is connected with a discharge side of a low-stage-side screw compressor is formed in the common ceiling wall portion 84. As shown in FIGS. 3 and 6A, the introducing-side first connecting port 28 is disposed on the intermediate ceiling wall portion 81 positioned above the first introducing port 27. An introducing-side first communication passage 29 which connects the introducing-side first connecting port 28 and the first introducing port 27 to each other is formed in the intermediate portion 80.

As shown in FIGS. 4 and 6A, on a first bottom wall portion 25 side of the first inner wall portion 24 of the inter cooler 20, a first discharging port 31 through which a gas is discharged from the inside of the first casing 21 is formed. The first discharging port 31 is disposed on the other side in the horizontal direction, that is, on a side opposite to the first introducing port 27 in the longitudinal direction of the first inner wall portion 24. The first discharging port 31 is an opening having an approximately rectangular shape. A lower end of the opening of the first discharging port 31 is positioned substantially at the same height as an upper surface of the first bottom wall portion 25 excluding a first drain recovery portion 43 described later. A length (width) of the first discharging portion 31 in the horizontal direction is longer than a length (height) of the first discharging port 31 in a vertical direction. As shown in 1A, a discharging-side first connecting port 32 which is connected with a suction side of the high-stage-side screw compressor is formed in the common ceiling wall portion 84. As shown in FIGS. 4 and 6A, the discharging-side first connecting port 32 is disposed on the intermediate ceiling wall portion 81 positioned above the first discharging port 31. A discharging-side first communication passage 33 which connects the discharging-side first connecting port 32 and the first discharging port 31 to each other is formed in the intermediate portion 80.

As shown in FIGS. 1A, 1B and 6A, the first cooling portion 35 includes the first mounting portion 36 which closes the proximal-end-side first opening 211 of the first casing 21 thus maintaining air-tightness of the opening 211. The first mounting portion 36 forms a part of the first cooling portion 35, and is mounted on the first casing 21. On the first mounting portion 36, a proximal-end-side cover 93 having a first inflow port 38 which allows cooling water to flow into a cooling water flow path in the first cooling portion (heat exchanger) 35 and a first outflow port 39 which allows cooling water to flow out from the cooling water flow path is mounted. To be more specific, the proximal-end-side cover 93 is mounted on the first mounting portion 36 so as to maintain a liquid-tightness of the first mounting portion 36. The first outflow port 39 is disposed above the first inflow port 38. Further, on the inter cooler 20, a first closing portion 37 which closes the distal-end-side first opening 212 of the first casing 21 and maintains air-tightness of the opening 212 is mounted. The first closing portion 37 also has a seal function for preventing cooling water from being leaked to the inside of the first casing 21 from the cooling water flow path on a distal end side of the first cooling portion heat exchanger) 35. A first distal end side cover 94A is mounted on the first closing portion 37. To be more specific, the first distal end side cover 94A is mounted on the first closing portion 37 so as to maintain liquid-tightness of the first closing portion 37.

The first inflow port 38 is connected to a cooling water supply part (not shown in the drawing). The first outflow port 39 is connected to a cooling water draining part (not shown in the drawing). A circulation path of the inter cooler 20 may be formed by connecting the draining part to the supply part.

Figure 7B:
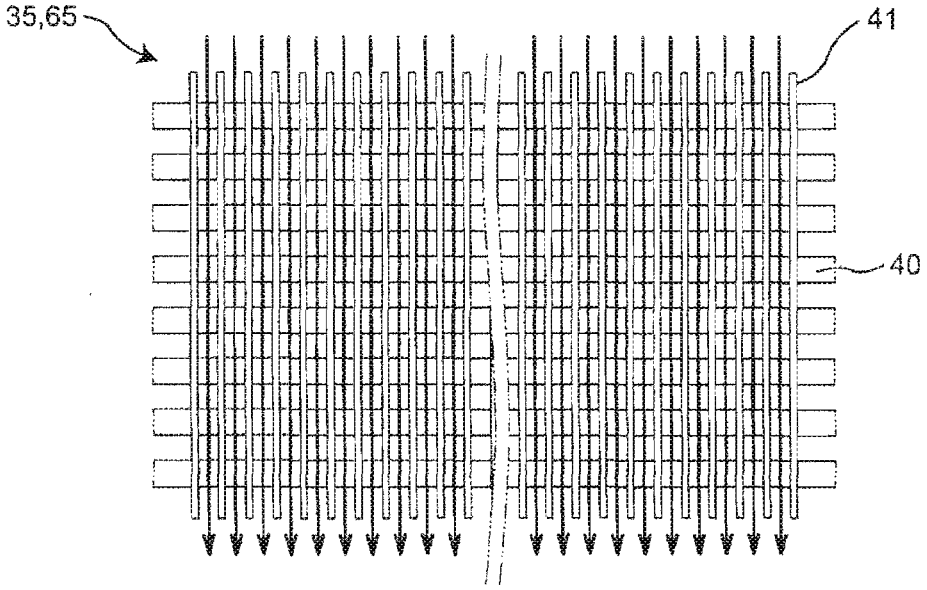
FIG. 7B is a schematic view for describing a plurality of cooling pipes to which a plurality of fins are integrally mounted.

As shown in FIGS. 7A and 7B, the first cooling portion 35 is a heat exchanger, and includes a plurality of cooling pipes 40 which constitute a cooling water flow path through which cooling water flows for cooling a gas. The cooling water flow path is formed in a meandering shape and is constituted of straight portions of the cooling pipes 40 and folded-back portions (not shown in the drawing) disposed in the first distal-end-side cover 94A. The respective cooling pipes 40 corresponding to the straight portions are arranged parallel to each other in an approximately horizontal direction. Accordingly, a gas flow path is formed between the respective cooling pipes (respective cooling water paths) 40. As shown in FIG. 6A, the first cooling portion 35 is inserted into the first casing 21 through the proximal-end-side first opening 211, is stored in the first casing 21, and is disposed between one side of the first casing 21 in the horizontal direction and the other side of the first casing 21 in the horizontal direction. The first cooling portion 35 is disposed within a region positioned below the first introducing port 27 and above the first discharging port 31.

Starting end opening portions of the respective cooling pipes 40 are connected to the first inflow port 38 of the first mounting portion 36. Terminal end opening portions of the respective cooling pipes 40 are connected to the first outflow port 39 of the first mounting portion 36. As shown in FIG. 7B, the first cooling portion 35 (heat exchanger) includes a plurality of fins 41 which are disposed in the gas flow path and cool a gas while guiding the flow of the gas. In an example shown in FIG. 7B, the plurality of cooling pipes 40 include the plurality of fins 41 integrally formed with the plurality of cooling pipes 40 and extending in the vertical direction. The plurality of fins 41 are arranged at intervals in a direction from one side of the first casing 21 in the horizontal direction to the other side of the first casing 21 in the horizontal direction. That is, the first cooling portion 35 is configured such that flow paths for guiding a gas in the vertical direction are formed between the fins 41, 41 from one side of the first casing 21 in the horizontal direction to the other side of the first casing 21 in the horizontal direction. As shown in FIGS. 7A and 8, the first cooling portion 35 is supported by the first support ribs 26 of the first casing 21 by way of the seal plates 42.

As shown in FIGS. 7A and 8, two seal plates 42 are mounted on the first cooling portion 35 so as to cover both side portions 35*a* while leaving releasing portions 87 on upper and lower sides uncovered. The seal plate 42 includes: a body 42*a*; an upper laterally-projecting portion 42*b*; a lower laterally-projecting portion 42*c*; an upper vertically-projecting portion 42*d*; and a lower vertically-projecting portion 42*e*. The laterally-projecting portions 42*b*, 42*c* are bent inwardly at an approximately right angle as viewed in an insertion direction at upper and lower ends of the body 42*a*. The vertically-projecting portions 42*d*, 42*e* are bent outwardly at an approximately right angle as viewed in the insertion direction at end portions of the laterally-projecting portions 42*b*, 42*c* on a side opposite to the body 42*a*. Accordingly, each seal plate 42 has a stepped portions 42B formed by bending on upper and lower ends thereof as viewed in the insertion direction. That is, the stepped portions 42B are formed by interposing the laterally-projecting portions 42*b*, 42*c* between the body 42*a* and the vertically-projecting portion 42*d*, 42*e* respectively. As viewed in the insertion direction, the pair of seal plates 42, 42 are formed such that lower end portions of the seal plates 42, 42 approach to each other. The bodies 42*a* are brought into contact with side surfaces of the first cooling portion 35 and, in this embodiment, the bodies 42*a* are brought into contact with both side portions 35*a* of the fins 41. The upper vertically-projecting portions 42*d*, 42*d* of the pair of seal plates 42, 42, and the lower vertically-projecting portions 42*e*, 42*e* of the pair of seal plates 42, 42 are respectively connected to each other by connecting spacers 86 in a spaced-apart manner thus defining the releasing portions 87. That is, the seal plates 42, 42 on both sides are integrated with each other by way of the pipe-shaped connecting spacers disposed at predetermined positions in the insertion direction. The downwardly-facing stepped surface 42A formed by the lower stepped portion 42B is a flat surface having a length substantially equal to a length of the first casing 21 in the insertion direction of the first cooling portion 35, and extends in the insertion direction of the first cooling portion 35. The stepped surface 42A is a contact surface which is brought into contact with the upper surface 26*a* of the first support rib 26, and is substantially parallel to the upper surface 26*a*.

As shown in FIG. 8, as viewed in the insertion direction, a size of a profile of the first cooling portion 35 in a state where the pair of seal plates 42, 42 is mounted on the first cooling portion 35 is smaller than a size of the proximal-end-side first opening 211 through which the first cooling portion 35 is inserted into the inside of the first casing 21. To be more specific, the size of the profile of the first cooling portion 35 where the side portions 35*a* of the first cooling portion 35 are covered by the pair of seal plates 42, 42 is smaller than the size of the opening 211. With respect to each seal plate 42, the downwardly-facing stepped surface 42A of the lower stepped portion 42B is supported by the upper surface 26*a* of the first support rib 26. With such a configuration, sealing is made between the stepped surface 42A and the upper surface 26*a* of the first support rib 26 from one end side to the other end side of the first casing 21. That is, at the first cooling portion 35, there are provided the seal plates 42 which partition the inside of the first casing 21 into an upper space (upstream-side space) 213 where a gas which has not yet passed through the first cooling portion 35 flows and a bottom-portion-side space (downstream-side space) 214 where a gas which has passed through the first cooling portion 35 flows.

Figure 13:
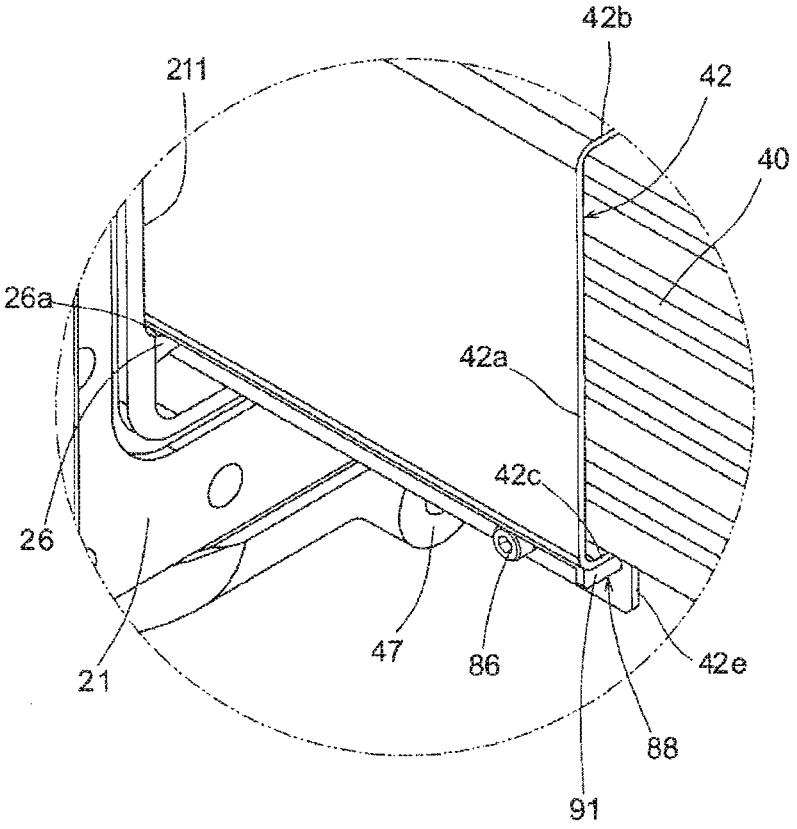
FIG. 13 is a partially-enlarged perspective view showing a positioning portion of a contact member mounted on the seal plate.

As shown in FIG. 13, a contact member 88 which has a positioning portion 91 which determines an insertion position of the seal plate 42 in the inside of the first casing 21 by being engaged with the support rib 26 may be mounted on a bottom surface of the laterally-projecting portion 42*c* of the seal plate 42. The contact member 88 is a thin plate member extending in the insertion direction so as to be brought into contact with the upper surface 26*a* of the first support rib 26. The positioning portion 91 is formed by bending the contact member 88, and is disposed in a downwardly extending manner at a position on an end portion of the seal plate 42 on a proximal-end-side first opening 211 side. With such a configuration, the positioning portion 91 is formed on the seal plate 42.

As shown in FIG. 6A, the upper space 213 is communicated with the first introducing port 27. The bottom-portion-side space 214 is communicated with the first discharging port 31. As shown in FIG. 8, the downwardly-facing stepped surfaces 42A of the lower stepped portions 42B are supported by the upper surfaces 26*a* of the first support ribs 26 and hence, the inside of the first casing 21 is partitioned into the upstream-side space 213 and the downstream-side space 214.

As shown in FIG. 6A, a first drain recovery portion 43 is disposed on the first bottom wall portion 25 of the first casing 21. The first drain recovery portion 43 recovers drain water generated due to condensation of moisture in a gas by cooling in the first cooling portion 35. The first drain recovery portion 43 is disposed such that a portion of the first drain recover portion 43 is disposed adjacently to the first discharging port 31. The first drain recovery portion 43 is formed of a recessed portion. A first draining hole 47 which communicates with the outside is formed in a bottom portion of the first drain recovery portion 43 (recessed portion).

As shown in FIG. 6B, a first discharging portion 45 through which drain water flown into the first drain recovery portion 43 is discharged to the outside is provided to the first draining hole 47 of the gas cooler 10. A first electromagnetic valve 46 is mounted on the first discharging portion 45. Opening and closing of the first electromagnetic valve 46 are controlled by a controller (not shown in the drawing). The illustration of the first discharging portion 45 and the first electromagnetic valve 46 is not, given in the drawings other than FIG. 6B.

Figure 11:
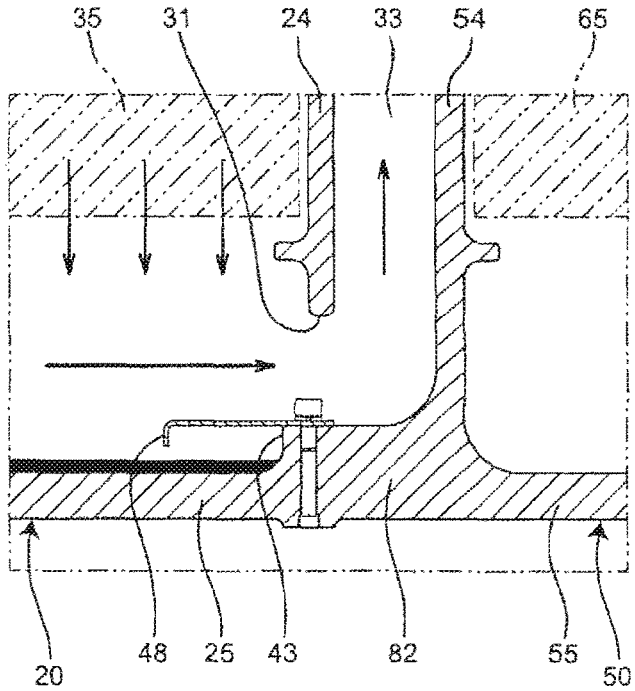
FIG. 11 is a cross-sectional view showing the flow of gas in a first casing.

As shown in FIGS. 6A and 11, a first blow-up preventing portion 48 which prevents blowing up of drain water from the first drain recovery portion 43 is provided to the first inner wall portion 24. The first blow-up preventing portion 48 is disposed directly above the first drain recovery portion 43 so as to extend in a direction intersecting with the first inner wall portion 24. The first blow-up preventing portion 48 is disposed on the first inner wall portion 24 such that there is no interposer between the first blow-up preventing portion 48 and the first drain recovery portion 43. The first blow-up preventing portion 48 of this embodiment is formed of a plate which is disposed below the first discharging port 31 and extends in a direction orthogonal to the first inner wall portion 24. In this embodiment, the first blow-up preventing portion 48 is disposed along a lower end of an opening of the first discharging port 31. That is, the first blow-up preventing portion 48 is disposed at a position where the blow-up preventing portion 48 does not obstruct the flow of a gas. A width of the blow-up preventing portion 48 is equal to a width of the first discharging port 31. As shown in FIG. 4, assuming a distance between the first outer wall portion 23 and the first inner wall portion 24 as D, a length L of the first blow-up preventing portion 48 is set to ⅓ to ¼ of the length D.

As shown in FIGS. 2 to 5, second introducing ports 57*a*, 57*b* through which a gas is introduced into the inside of the second casing 51 are formed on an inner surface side of the second ceiling wall portion 52 of the after cooler 50. The second introducing ports 57*a*, 57*b* are disposed at substantially the center in the horizontal direction (a longitudinal direction of the second casing 51). An introducing direction of the second introducing port 57*a* is a direction toward one side in the horizontal direction (toward a second closing portion 67 side). An introducing direction of the second introducing port 57*b* is a direction toward the other side in the horizontal direction (toward the second mounting portion 66 side). The second introducing ports 57*a*, 57*b* have an approximately semicircular shape as viewed from a side where the second introducing ports 57*a*, 57*b* open. As shown in FIG. 1A, an introducing-side second connecting port 58 which is connected with a discharge side of the high-stage-side screw compressor is formed in the common ceiling wall portion 84. The introducing-side second connecting port 58 is disposed at the center in a longitudinal direction of the second ceiling wall portion 52. An introducing-side second communication passage 59 which connects the introducing-side second connecting port 58 and the second introducing ports 57*a*, 57*b* to each other is formed in the second casing 51.

Figure 2:
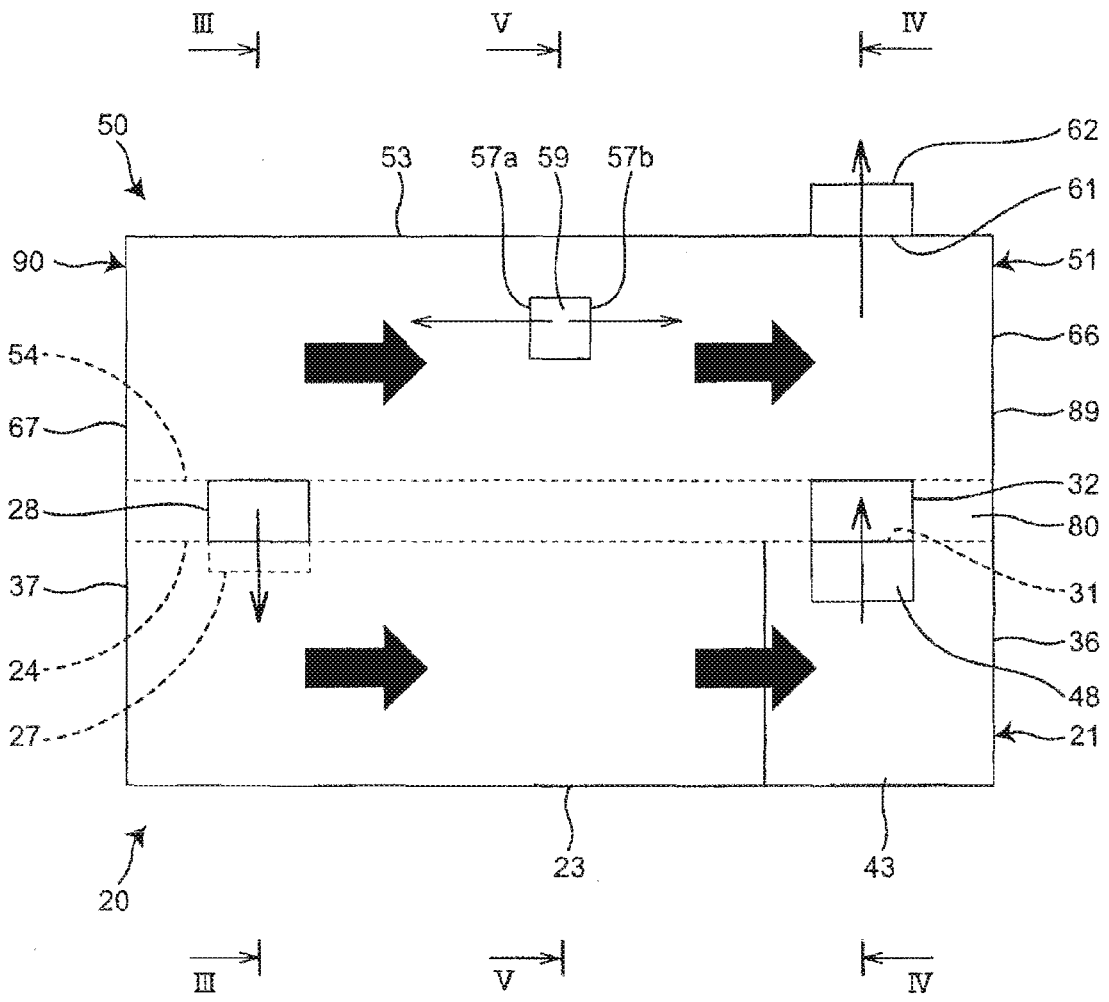
FIG. 2 is a schematic view showing the positional relationship in a horizontal direction of an introducing port, a discharging port, and a connection port of the gas cooler of the present invention.

As shown in FIGS. 2 and 4, a second discharging port 61 through which a gas is discharged from the inside of the second casing 51 is formed on the second outer wall portion 53 of the after cooler 50 on a second bottom wall portion 55 side. The second discharging port 61 is disposed on the other side in the horizontal direction (the second mounting portion 66 side). The second discharging port 61 is formed of an opening having an approximately rectangular shape. A length (width) in the horizontal direction of the second discharging port 61 is longer than a length (height) in the vertical direction of the second discharging port 61. A discharging-side second connecting port 62 which is connected with the destination to which compressed air is supplied (not shown in the drawing) is provided to the second discharging port 61.

As shown in FIG. 1A, in the same manner as the inter cooler 20, the after cooler 50 includes the second mounting portion 66, the proximal-end-side cover 93, the second closing portion 67, and a second distal-end-side cover 94B. The second mounting portion 66 includes the proximal-end-side cover 93 having a second inflow port (not shown in the drawing) which allows cooling water to flow into the cooling water flow path of the second cooling portion (heat exchanger) 65 and a second outflow port 69 which allows cooling water to flow out from the cooling water flow path. To be more specific, the proximal-end-side cover 93 is mounted so as to maintain a liquid-tightness of the second mounting portion 66. The second outflow port 69 is disposed above the second inflow port (not shown in the drawing). The after cooler 50 also includes the second closing portion 67 which closes the distal-end-side second opening 512 of the second casing 51 thus maintaining an air-tightness of the opening 512. The second closing portion 67 also has a seal function for preventing cooling water from being leaked to the inside of the second casing 51 from the cooling water flow path on a distal end side of the second cooling portion (heat exchanger) 65. The second distal-end-side cover 94B is mounted on the second closing portion 67. To be more specific, the second distal-end-side cover 94B is mounted so as to maintain a liquid-tightness of the second closing portion 67.

The second inflow port (not shown in the drawing) is connected with a cooling water supply part (not shown in the drawing). The second outflow port 69 is connected with a cooling water draining part (not shown in the drawing). A circulation passage may be formed by connecting the draining part to the supply part.

The second cooling portion 65 mounted on the second casing 51 of the after cooler 50 has substantially the same configuration as the first cooling portion 35 mounted on the first casing 21 of the inter cooler 20.

In the example shown in FIG. 1A, the proximal-end-side covers 93 which are mounted on the first mounting portion 36 and the second mounting portion 66 are formed as an integral body. However, the proximal-end-side covers 93 may be provided individually such that one proximal-end-side covers 93 is mounted on the first mounting portion 36 and the other proximal-end-side covers 93 is mounted on the second mounting portion 66. Further, the distal-end-side covers 94A, 94B are mounted on the first closing portion 37 and the second closing portion 67 individually. However, the distal-end-side covers 94A, 94B mounted on the first closing portion 37 and the second closing portion 67 may be formed as an integral body.

The seal plate 42 mounted on the second cooling portion 65 has substantially the same configuration as the seal plate 42 mounted on the first cooling portion 35 of the first casing 21.

The contact member 88 is mounted on the seal plate 42 mounted on the second cooling portion 65 in the same manner as the seal plate 42 mounted on the first cooling portion 35.

In the same manner as the first drain recovery portion 43 shown in FIG. 6A, a second drain recovery portion (not shown in the drawing) is provided to the second bottom wall portion 55 of the second casing 51.

As shown in FIG. 6B, the second casing 51 is provided with a second discharging portion 75, a second electromagnetic valve 76, and a second draining hole 77.

In the same manner as the first blow-up preventing portion 48 of the inter cooler 20, the second outer wall portion 53 is provided with a second blow-up preventing member (not shown in the drawing).

Figure 9:
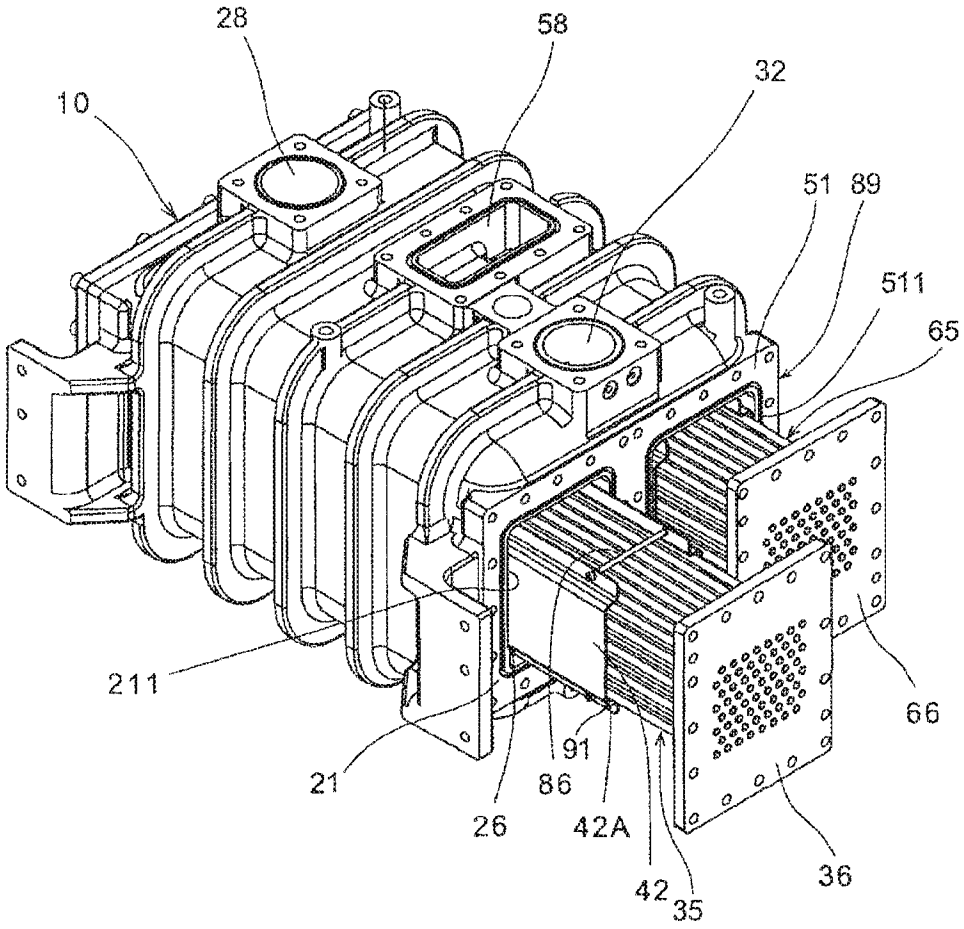
FIG. 9 is a perspective view showing a state in the course of inserting a cooling portion into a casing.
Figure 10:
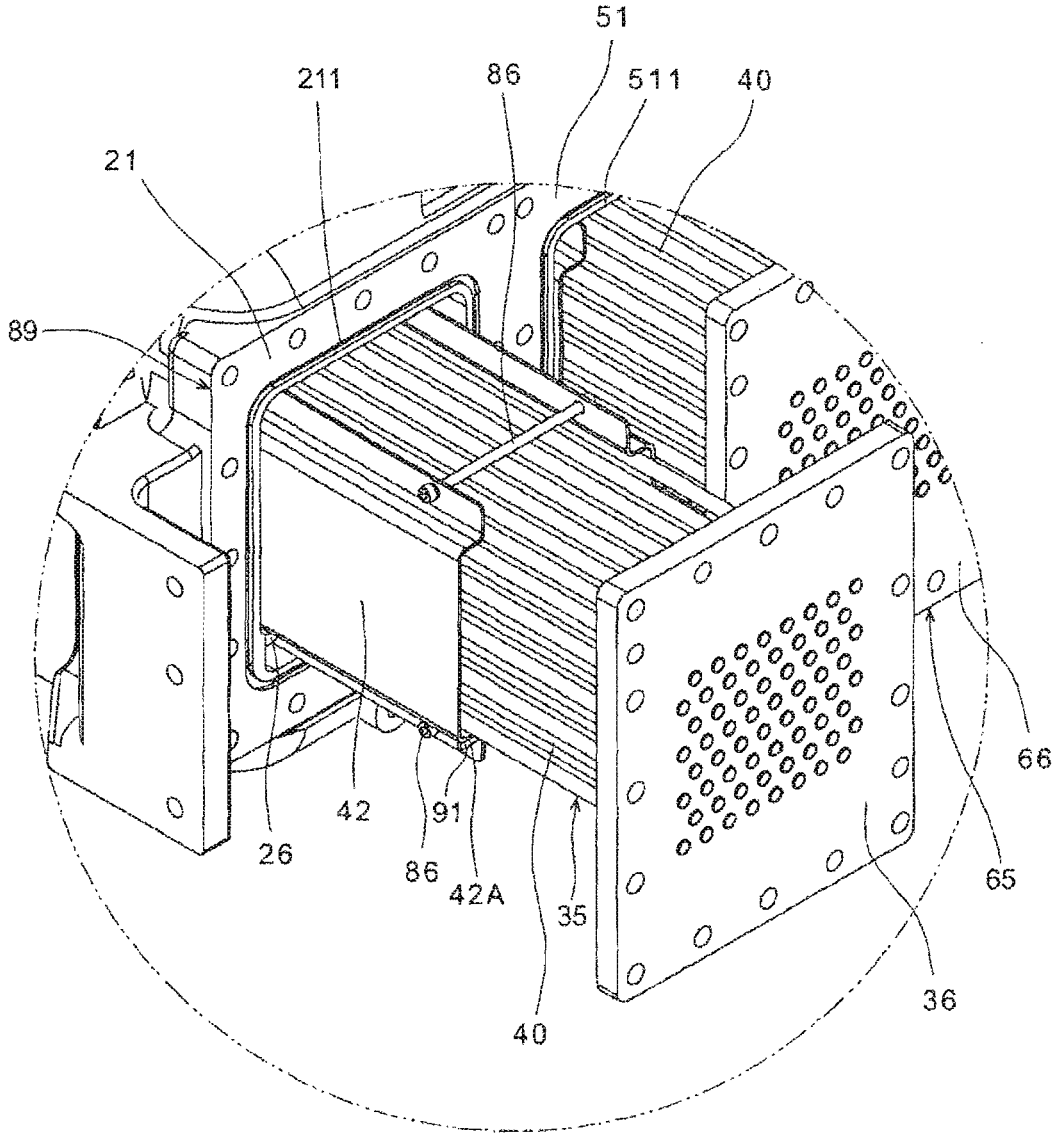
FIG. 10 is an enlarged perspective view showing a state in the course of inserting the cooling portion into the casing.

The pair of seal plates 42, 42 is mounted on the first cooling portion 35. Next, a distal end of the first cooling portion 35 on which the seal plates 42, 42 are mounted is made to pass through the proximal-end-side first opening 211 and, as shown in FIGS. 8 to 10, the downwardly-facing stepped surfaces 42A of the lower stepped portions 42B of the seal plates 42 are placed on the upper surfaces 26*a* of the first support ribs 26, and the first cooling portion 35 on which the seal plates 42, 42 are mounted is pushed to a depth side. Thereafter, the first mounting portion 36 and the first closing portion 37 are mounted on the first casing 21 so as to obtain a state shown in FIG. 1A. The second cooling portion 65 is assembled into the second casing 51 substantially in the same manner as the assembling of the first cooling portion 35.

The manner of operation of the gas cooler 10 of the present invention having the above-mentioned configuration is described.

A gas (compressed air) is fed to the introducing-side first connecting port 28 of the inter cooler 20 from a discharge side of the low-stage-side screw compressor. As shown in FIGS. 6A and 6B, the gas (compressed air) introduced from the first introducing port 27 through the introducing-side first connecting port 28 is introduced into the upper first space 213, and is fed to the first cooling portion 35 from above. The direct movement of a gas in the upper first space 213 to the bottom-portion-side first space 214 is prevented by sealing between the downwardly-facing stepped surface 42A of the lower stepped portion 42B of the seal plate 42 and the upper surface 26*a* of the first support rib 26. A gas fed to the first cooling portion 35 moves to a lower side from an upper side along the fins 41, 41 as shown in FIG. 7B, that is, to the bottom-portion-side first space 214 from the first cooling portion 35. At this stage of the operation, the gas is brought into contact with outer surfaces of the cooling pipes 40 and the fins 41 of the first cooling portion 35 so that the gas is cooled by a heat exchange with cooling water in the cooling pipes 40. Moisture in the cooled gas becomes droplets, and such droplets move along the cooling pipes 40 and the fins 41, and fall to the first bottom wall portion 25. Further, with respect to some liquid droplets adhered to the cooling pipes 40 and the fins 41, falling of the droplets is accelerated by a gas guided to flow from above to below. Liquid droplets which fall on the first bottom wall portion 25 become drain water. Further, drain water is fed to the first drain recovery portion 43 disposed below the first blow-up preventing portion 48 by obtaining a propulsion force from a gas moving along the first bottom wall portion 25.

As shown in FIG. 11, a gas which moves along the first bottom wall portion 25 in the inside of the inter cooler 20 advances along an upper side of the first blow-up preventing portion 48, and flows out from the first discharging port 31. The gas which flows out from the first discharging port 31 passes through the discharging-side first communication passage 33 and the discharging-side first connecting port 32, and is fed to a suction side of the high-stage-side screw compressor. Since the first blow-up preventing portion 48 is provided to the first inner wall portion 24, when a gas flows out from the first discharging port 31, the gas is not accompanied with drain water in the first drain recovery portion 43. That is, it is possible to prevent drain water recovered by the first drain recovery portion 43 from being blown up to the first discharging port 31 from the first drain recovery portion 43.

In the after cooler 50, a gas (compressed air) is introduced into the introducing-side second connecting port 58 from a discharge side of the high-stage-side screw compressor. The introduced gas passes through the second introducing ports 57*a*, 57*b*, and is discharged from the second discharging port 61. The discharged gas is fed to the discharging-side second connecting port 62, and is supplied to the destination (not shown in, the drawing) to which compressed air is supplied.

The internal configuration and the manner of operation of the after cooler 50 are also substantially equal to the internal configuration and the manner of operation of the inter cooler 20 and hence, the description of the internal configuration and the manner of operation of the after cooler 50 is not given.

With the above-mentioned configuration, as shown in FIG. 8, the pair of seal plates 42, 42 is placed on the pair of first support ribs 26, 26 which projects to the inside of a first casing 21. The first cooling portion 35 is supported by the pair of first support ribs 26, 26 of the first casing 21 by way of the pair of seal plates 42, 42 and hence, sealing can be easily made between the downwardly-facing stepped surfaces 42A of the lower stepped portions 42B of the seal plates 42 and the first support ribs 26, 26. With such a configuration, even when the seal plates 42, 42 are not brought into pressure contact with the side wall portions 23, 24 of the first casing 21, the inside of the first casing 21 can be partitioned into an upstream-side space 213 and a downstream-side space 214 with a first cooling portion 35 interposed therebetween. That is, the inside of the first casing 21 can be partitioned such that the upstream-side space 213 forms a high-temperature-side space, and the downstream-side space 214 forms a low-temperature-side space thus enhancing heat transfer efficiency of the inter cooler 20. Accordingly, cooling efficiency of the inter cooler 20 can be enhanced. Further, the downwardly-facing stepped surfaces 42A of the lower stepped portions 42B of the seal plates 42 which extend in the insertion direction of the first cooling portion 35 are placed on the first support ribs 26 extending in the insertion direction respectively. With such a configuration, the inside of the first casing 21 can be partitioned into the upstream-side space 213 and the downstream-side space 214 and hence, assembling operability, that is, maintainability can be enhanced. Accordingly, cooling efficiency and maintainability of the gas cooler 20 can be enhanced.

Advantageous effects obtained by the second casing 51 are also substantially equal to the above-mentioned advantageous effects obtained by the first casing 21. That is, the advantageous effects obtained by the after cooler 50 is also substantially equal to the above-mentioned advantageous effects obtained by the inter cooler 20.

The inside of the casing 21, 51 can be partitioned vertically and hence, the flow of a gas can be directed from an upper side to a lower side whereby a drain can be easily separated from the cooling portion 35, 65.

The first support rib 26 can be used also as a rib. By allowing the first support rib 26 to function as the rib, the expansion of center portions of the respective side wall portions 23, 24 of the first casing 21 in the insertion direction can be suppressed and hence, a stress and, eventually, displacement in the side wall portions 23, 24 of the first casing 21 can be reduced. Accordingly, reliability on strength of the gas cooler 20 having an approximately rectangular parallelepiped shape can be enhanced.

Advantageous effects obtained by the second casing 51 are also substantially equal to the above-mentioned advantageous effects obtained by the first casing 21. That is, advantageous effects obtained by the after cooler 50 are also substantially equal to the above-mentioned advantageous effects obtained by the inter cooler 20.

The support ribs 26, 56 can be used as the guides and hence, the cooling portion 35, 65 can be inserted into the inside of the casing 21, 51 while allowing the cooling portion 35, 65 to slide on the guides by way of the seal plates 42. Further, as shown in FIG. 8, the cooling portion 35, 65 can be inserted into the inside of the casing 21, 51 by making use of the laterally-projecting portions 42*c* (stepped portions 42B) of the seal plates 42 having a conventionally-used configuration where the vertically-projecting portions 42*e*, 42*e* are connected to each other by the connecting spacer 86. Further, the cooling portion 35, 65 can be inserted into the inside of the casing 21, 51 or taken out to the outside through the opening 211, 511 without inclining the cooling portion 35, 65. Accordingly, the cooling portion 35, 65 can be installed more easily thus remarkably enhancing maintainability. Still further, it is possible to avoid applying of an extra external force to the cooling portion 35, 65 and the seal plates 42 from the casing 21, 51 at the time of inserting the cooling portion 35, 65.

The downwardly-facing stepped surfaces 42A of the lower stepped portions 42B of the seal plates 42 and the upper surfaces 26*a*, 56*a* of the support ribs 26, 56 are respectively formed of a flat surface having a length substantially equal to a length of the casing 21, 51 in the insertion direction of the casing 21, 51. Accordingly, sealing can be made with certainty between the stepped surface 42A and the upper surface 26*a*, 56*a* of the support rib 26, 56 thus enhancing heat transfer efficiency of the gas cooler 20, 50. Accordingly, cooling efficiency of the gas cooler 20, 50 can be enhanced. Further, the cooling portion 35, 65 can be smoothly inserted into the inside of the casing 21, 51 and hence, in the installation of the cooling portion 35, 36

(insertion operation and positioning operation), assembling operability, that is, maintainability can be enhanced.

As shown in FIG. 8, the first cooling portion 35 can be inserted into the inside of the first casing 21 in a state where the lower end portions of the pair of seal plates 42, 42 disposed below the downwardly-facing stepped surfaces 42A of the lower stepped portions 42B of the seal plates 42, 42, that is, the lower vertically-projecting portions 42*e*, 42*e* are positioned between the pair of first support ribs 26, 26. Accordingly, the first cooling portion 35 can be inserted into the inside of the first casing 21 while the positional regulation in the vertical direction is performed by the downwardly-facing stepped surfaces 42A and the first support ribs 26 and, at the same time, the positional regulation in the lateral direction is performed by the lower end portions 42*e* disposed below the downwardly-facing stepped surfaces 42A and the first support ribs 26. Accordingly, stability of insertion of the first cooling portion 35 can be enhanced.

Advantageous effects obtained by the second casing 51 are also substantially equal to the above-mentioned advantageous effects obtained by the first casing 21. That is, advantageous effects obtained by the after cooler 50 are also substantially equal to the above-mentioned advantageous effects obtained by the inter cooler 20.

The cooling portion 35, 65 has the plurality of cooling pipes 40 through which cooling water flows, and gas flow paths are disposed between the plurality of cooling pipes 40. With such a configuration, it is possible to allow a gas to pass through the cooling portion 35, 65 without being brought into contact with cooling water.

As shown in FIG. 13, by providing the contact member 88 having a bent portion 91 to the seal plates 42, the seal plates 42 can be always positioned at desired seal positions in the inside of the casing 21, 51.

The fins 41 are provided to the cooling portion 35, 65 such that a gas introduced from the introducing ports 27, 57*a*, 57*b* can be easily made to flow from an upper side to a lower side and hence, gas cooling efficiency and drain separation efficiency can be enhanced.

The introducing ports 27, 57*a*, 57*b* are disposed above the cooling portion 35, 65, and the fins 41 are formed in the cooling portion 35, 65 so that a gas introduced into the cooling portion 35, 65 from the introducing ports 27, 57*a*, 57*b* is made to easily flow from an upper side to a lower side and hence, gas cooling efficiency and drain separation efficiency can be enhanced. That is, it is possible to guide a gas such that the flow of the gas introduced from the introducing ports 27, 57*a*, 57*b* forms a descending flow and hence, gas cooling efficiency and drain separation efficiency can be enhanced. Further, it is possible to prevent a gas from flowing through a shortest route where a gas flows across the cooling portion 35, 65 in an oblique direction toward the discharging ports 31, 61 from the introducing ports 27, 57*a*, 57*b* and hence, gas cooling efficiency and drain separation efficiency can be enhanced.

The cooling portion 35, 65 is disposed below the introducing ports 27, 57*a*, 57*b* and above the discharging port 31, 61 and hence, a gas introduced into the cooling portion 35, 65 from the introducing ports 27, 57*a*, 57*b* can be sufficiently cooled by the cooling portion 35, 65. Particularly, by expanding the gas flow path by providing the space 213, 51.3 on an upper side of the casing 21, 51 such that the space 213, 513 is communicated with the introducing ports 27, 57*a*, 57*b*, a flow speed of a gas can be decreased so that a gas can be sufficiently cooled. Accordingly, it is possible to sufficiently condense moisture in the gas by the cooling portion 35, 65 thus sufficiently separating moisture from the gas. Accordingly, gas cooling efficiency and drain separation efficiency can be enhanced. Further, due to the descending flow of a gas which passes through the cooling portion 35, 65, moisture in the gas which is condensed by the cooling portion 35, 65 can be easily made to fall on the bottom wall portion 25, 55. The introducing ports 27, 57*a* open in a direction that a gas introduced into the inside of the casing 21, 51 is made to temporarily flow away from the discharging port 31, 61. Accordingly, an amount of gas which is introduced from the introducing ports 27, 57*a* and flows along a shortest route to the discharging port 31, 61 can be decreased and hence, cooling of a gas can be effectively performed.

As shown in FIG. 11, moisture which falls on the first bottom wall portion 25, that is, drain water can be moved to the first drain recovery portion 43 disposed adjacently to the first discharging port 31 and positioned below the first blow-up preventing portion 48 by a gas which moves along the first bottom wall portion 25. Particularly, the first blow-up preventing portion 48 is disposed on the first inner wall portion 24 such that the first blow-up preventing portion 48 is positioned below the first discharging port 31 and directly above the first drain recovery portion 43 and hence, it is possible to prevent drain water recovered by the first drain recovery portion 43 from being blown up to the first discharging port 31 by and in accompany with a flowing gas. Accordingly, it is possible to prevent drain water from flowing into an apparatus which is connected to a downstream side of the inter cooler 20, that is, the high-stage-side screw compressor. Therefore, it is possible to avoid a damage of the apparatus (high-stage-side screw compressor) due to inflow of drain water. Further, the gas flow path is formed above the first blow-up preventing portion 48, and the drain water flow path is formed below the first blow-up preventing portion 48 and hence, the generation of an air pressure loss, that is, the lowering of performance can be avoided.

Advantageous effects obtained by the second casing 51 are also substantially equal to the above-mentioned advantageous effects obtained by the first casing 21. That is, advantageous effects obtained by the after cooler 50 are also substantially equal to the above-mentioned advantageous effects obtained by the inter cooler 20.

Drain water recovered by the recessed portion of the first drain recovery portion 43 can be automatically discharged from the first discharging portion 45 by opening the first electromagnetic valve 46. Drain water recovered by the recessed portion of the second drain recovery portion (not shown in the drawing) can be also discharged in the same manner.

Further, it is possible to avoid a phenomenon that drain water is carried into the supply destination of compressed air which is connected to a downstream side of the after cooler 50. Accordingly, it is possible to avoid the occurrence of a failure in the supply destination of compressed air due to carrying of drain water into the supply destination.

The gas cooler 10 of the present invention is not limited to the configuration of the embodiment, and various modifications are conceivable as exemplified hereinafter.

The gas cooler of the present invention may be a gas cooler formed by connecting the single inter cooler 20 and the single after cooler 50, or may be formed of either one of the inter cooler 20 or the after cooler 50.

Figure 12:
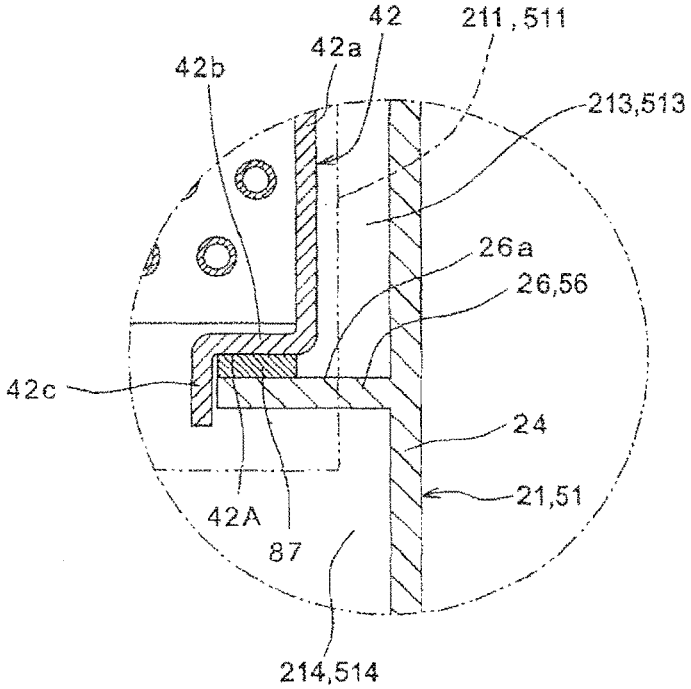
FIG. 12 is an enlarged schematic view for describing a seal plate on which a resilient member is mounted.

As shown in FIG. 12, a resilient member 87 may be formed on the downwardly-facing stepped surface 42A such that the resilient member 87 extends over the whole length of the downwardly-facing stepped surface 42A in the longitudinal direction. With such a configuration, there is no possibility that a gap is formed between the seal plate 42 and the casing 21, 51 when the seal plate 42 is mounted on the casing 21, 51 by being placed on the support rib 26, 56. That is, even in the case where a gap is formed between the seal plate 42 and the support rib 26, 56 when the seal plate 42 is directly placed on the support rib 26, 56, by placing the seal plate 42 on the support rib 26, 56 with the resilient member 87 interposed therebetween, the gap can be filled with the resilient member 87. With such a configuration, it is possible to prevent with certainty a high-temperature gas in the upstream-side space 213, 513 from flowing into the downstream-side space 214, 514 through a short path and hence, cooling efficiency can be enhanced.

It is preferable that the resilient member 87 be a sponge-like resilient body. With such a configuration, the resilient member 87 can be formed using a relatively inexpensive material.

Figure 14:
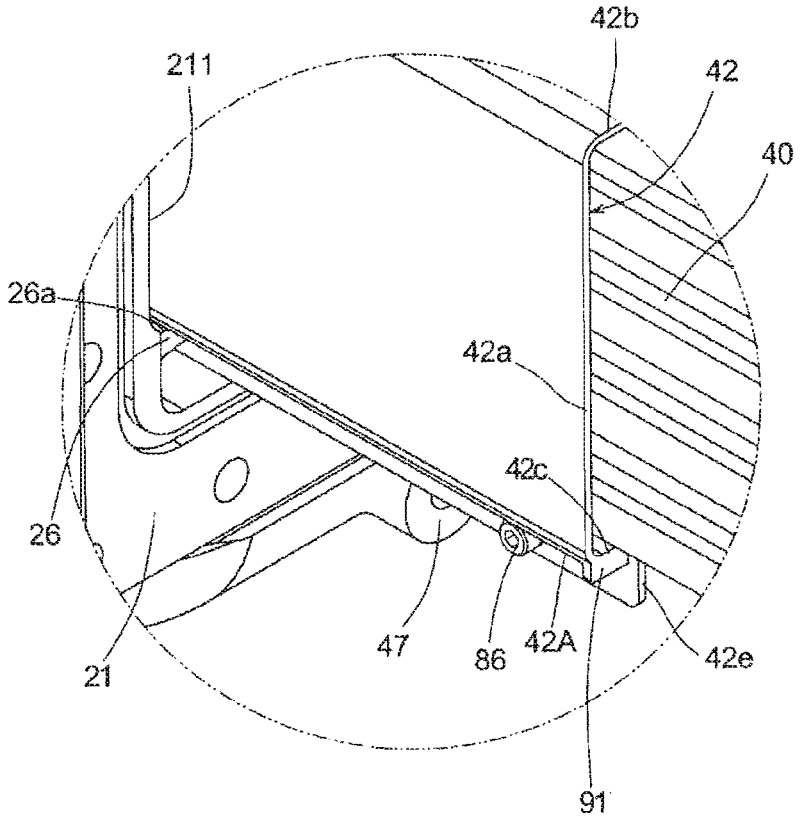
FIG. 14 is a partially-enlarged perspective view showing positioning portion integrally formed with the seal plate.

In the embodiment described heretofore, the contact members 88, 88 each having the bent portion 91 are mounted on bottom surfaces of the laterally-projecting portions 42*c* of the seal plates 42 as separate members. However, as shown in FIG. 14, only the bent portion 91 may be integrally formed with the seal plate 42 as the positioning portion. The contact member 88 may be formed of a protective member made of a material having higher wear resistance or a material having higher corrosion resistance than a material for forming the seal plate 42, or may be formed of a member made of a material having a lower friction coefficient than a material for forming the seal plate 42 for smoothly inserting the contact member 88 through the proximal-end-side first opening 211, 511.

Figure 15:
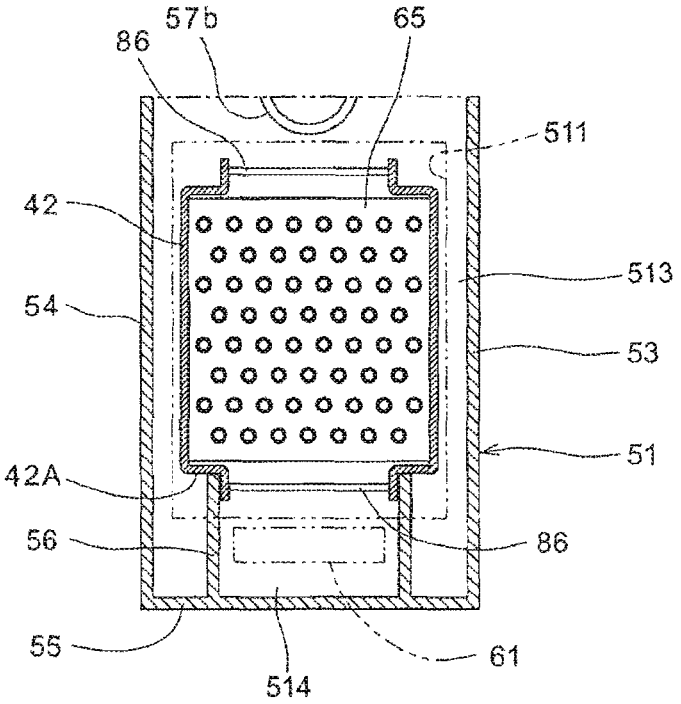
FIG. 15 is a schematic view showing a cross section in a lateral direction of a gas cooler according to a modification of the present invention.
Figure 16:
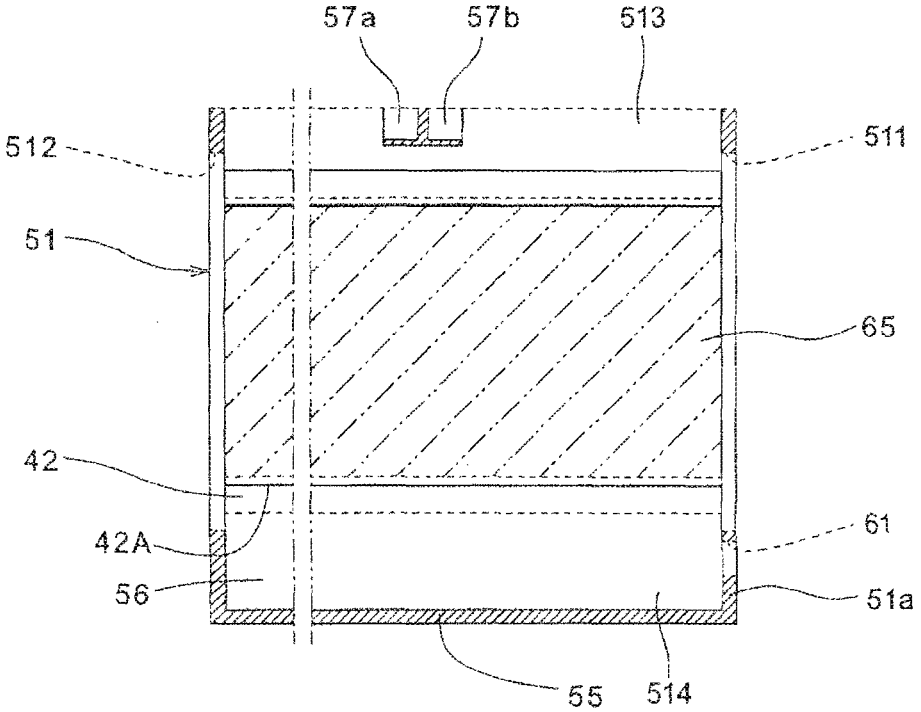
FIG. 16 is a schematic view showing a cross-section in a longitudinal direction of the gas cooler according to the modification of the present invention.

As shown in FIGS. 15 and 16, a side wall portion 51*a* may be formed on the second casing 51 at a position below the proximal-end-side second opening 511 and the second mounting portion (not shown in the drawing). Further, the pair of second support ribs (support portions) 56, 56 may be provided in an upwardly extending manner from the second bottom wall portion 55 and, at the same time, the second discharging port 61 may be formed in the side wall portion 51*a* between the second support ribs (support portions) 56, 56. Such a configuration may be applied to only the inter cooler 20 or may be applied to both the inter cooler 20 and the after cooler 50.

The invention claimed is:

1. A gas cooler comprising:

a casing having an opening;

an introducing port through which a gas is introduced into an inside of the casing;

a discharging port through which the gas is discharged from the inside of the casing;

a cooling portion which is insertable into the casing through the opening, is housed in the casing, cools the gas, and maintains air-tightness against the casing;

a pair of seal plates disposed on the cooling portion, wherein each seal plate has a portion to be supported which extends in an insertion direction that the cooling portion is inserted; and a pair of support portions supporting the portions to be supported, wherein each support portion is disposed on an inner surface of the casing such that each support portion projects into the inside of the casing and extends in the insertion direction, wherein the inside of the casing is partitioned into an upstream-side space in communication with the introducing port and a downstream-side space in communication with the discharging port when the portions to be supported are placed on the support portions, wherein each of the seal plates includes a body portion and at least one stepped portion, wherein the at least one stepped portion includes a vertically projecting portion that is parallel to the body portion of the respective seal plate, and a laterally projecting portion extending between and connecting the body portion of the respective seal plate and the vertically projecting portion, wherein the portions to be supported are downwardly-facing surfaces of the laterally projecting portions, and wherein each vertically projecting portion of the respective at least one stepped portion is closer to a vertical centerline of the cooling portion than the body portion of the respective seal plate.

2. The gas cooler according to claim 1, wherein the casing further includes a pair of side wall portions which opposedly face each other as viewed in the insertion direction, and wherein the pair of support portions are disposed on inner surfaces of said both pair of side wall portions, respectively.

3. The gas cooler according to claim 1, wherein the casing has a bottom wall portion, and wherein the pair of support portions is disposed on an inner surface of the bottom wall portion as viewed in the insertion direction.

4. The gas cooler according to claim 2, wherein the inner surfaces of said pair of side wall portions are flat surfaces, and wherein the inner surfaces of said pair of side wall portions and the support portions are integrally formed with each other along the insertion direction, respectively.

5. The gas cooler according to claim 1, wherein a size of a profile of the cooling portion is smaller than a size of the opening as viewed in the insertion direction, wherein the pair of support portions project inwardly from a peripheral edge of the opening, and wherein the pair of seal plates are movable in the insertion direction when the support portions and the portions to be supported are in contact with each other.

6. The gas cooler according to claim 1, wherein a resilient member is disposed on the stepped surface, and wherein the resilient member is interposed between the downwardly-facing surfaces of the laterally projecting portion and the support portion when the downwardly-facing stepped surfaces are placed on the support portion.

7. The gas cooler according to claim 6, wherein the resilient member is a porous resilient body.

8. The gas cooler according to claim 5, wherein the cooling portion has a plurality of cooling water flow paths through which cooling water flows, and wherein gas flow paths are disposed between the plurality of cooling water flow paths.

9. The gas cooler according to claim 8, wherein the plurality of cooling water flow paths are formed of a plurality of cooling pipes each of which has a straight portion extending in the insertion direction, the straight portions being parallel to each other, wherein the plurality of cooling water flow paths include a plurality of fins which are disposed at intervals from each other in the insertion direction, and are integrally formed with the cooling pipe, and wherein the pair of seal plates is disposed outside of the plurality of fins so as to cover side portions of the cooling portion.

10. The gas cooler according to claim 1, wherein the seal plate includes a positioning portion which determines an insertion position for insertion of the cooling portion into the inside of the casing.

11. The gas cooler according to claim 1, wherein each vertically projecting portion horizontally aligns the cooling portion when the cooling portion is being inserted into the casing.

12. The gas cooler according to claim 1, wherein at least one vertically projecting portion on each seal plate engages with and contacts one of the pair of support portions to horizontally align the cooling portion when the cooling portion is being inserted into the casing.

* * * * *